US007342192B2

(12) United States Patent
Yin et al.

(10) Patent No.: US 7,342,192 B2
(45) Date of Patent: Mar. 11, 2008

(54) RESILIENT SWITCH

(75) Inventors: Su-Tane Yin, Shanghai (CN); Hong-Chao Liu, Shanghai (CN)

(73) Assignee: Inventec Appliances Corp., Taipei (TW)

( * ) Notice: Subject to any disclaimer, the term of this patent is extended or adjusted under 35 U.S.C. 154(b) by 0 days.

(21) Appl. No.: 11/545,448

(22) Filed: Oct. 11, 2006

(65) Prior Publication Data

US 2007/0099482 A1 May 3, 2007

(30) Foreign Application Priority Data

Oct. 27, 2005 (TW) ..... 94218540 U

(51) Int. Cl.
*H01H 13/02* (2006.01)

(52) U.S. Cl. ..... 200/296; 200/343

(58) Field of Classification Search ..... 200/296, 200/341–345; 341/22; 345/168, 169
See application file for complete search history.

(56) References Cited

U.S. PATENT DOCUMENTS 5,552,956 A * 9/1996 Pasquarette et al. ..... 200/343
5,927,483 A * 7/1999 Yamada ..... 200/343
5,990,432 A * 11/1999 Kuroda ..... 200/343
6,552,282 B2 * 4/2003 Lewis ..... 200/343
6,964,532 B1 * 11/2005 Lu ..... 200/341
7,002,086 B2 * 2/2006 Fuji ..... 200/343
7,071,434 B1 * 7/2006 McConnell et al. ..... 200/343
7,098,417 B1 * 8/2006 Fuji ..... 200/343
7,126,069 B2 * 10/2006 Mukougawa et al. ..... 200/343
7,268,312 B2 * 9/2007 Chen ..... 200/343

* cited by examiner

*Primary Examiner*—Michael A Friedhofer
(74) *Attorney, Agent, or Firm*—Bacon & Thomas, PLLC

(57) ABSTRACT

The present invention is to provide a resilient switch mounted in a housing and comprising a flexible arm including a first seat formed on one end of the flexible arm and a second seat formed on the other end of the flexible arm. After fastening the second seat on a first inner surface of the housing, the pressing member projects out of the housing through an opening on the first inner surface of the housing. A first projection is formed on a second surface of the flexible arm opposite the pressing member and is disposed proximate the second seat. A portion of the first projection opposite the flexible arm is extended to be proximate a second inner surface of the housing opposite the first inner surface of the housing. By utilizing this resilient switch, the first seat moves toward the second inner surface of the housing when a pressing force is exerted upon the pressing member. A portion of the flexible arm from the first projection to the first seat is resiliently deflected with a resilient bouncing force stored therein. Thus, the resilient bouncing force can push the pressing member out of the housing again in response to removing the pressing force exerted upon the pressing member.

6 Claims, 4 Drawing Sheets

RESILIENT SWITCH

FIELD OF THE INVENTION

The present invention relates to switches for computer or electronic device and more particularly to an improved resilient switch with a flexible arm.

BACKGROUND OF THE INVENTION

A conventional reset button 10 mounted on a computer or electronic device for resetting the computer or electronic device (i.e., warm boot) is shown in FIG. 1. The reset button 10 comprises an elongate piece 11, a pressing member 12 formed at one end of the elongate piece 11, a fixing member 13 formed at the other end of the elongate piece 11, and a fastening member 15 provided on an inner surface of a housing 14 for fastening the fixing member 13. The elongate piece 11 is mounted on the inner surface of the housing 14. Further, the pressing member 12 is aligned with an opening 16 on the inner surface of the housing 14 and is adapted to project out of the housing 14 through the opening 16. Thus, a user may press the pressing member 12 from outside of the housing 14. A stop block 17 is further provided in the conventional configuration. The stop block 17 is mounted on the inner surface of the housing 14 with a portion of the elongate piece 11 concealed therein. The stop block 17 is also abutted against one side of the fixing member 13. Thus, the portion of the elongate piece 11 adjacent the fixing member 13 is affixed on the inner surface of the housing 14. In operation, a user may press the pressing member 12 to cause both the pressing member 12 and a portion of the elongate piece 11 from the pressing member 12 to the stop block 17 to move away from the opening 16 on the housing 14. It is understood that a resilient bouncing force is stored by a portion of the elongate piece 11 between the stop block 17 and the pressing member 12 as taught by the principles of lever. Thus, the resilient bouncing force can push the pressing member 12 out of the housing 14 again in response to removing the pressing force exerted upon the pressing member 12.

However, the prior reset button 10 suffered from a couple of disadvantages. In detail, the elongate piece 11 is relatively long in length. Thus, the resilient bouncing force stored by a portion of the elongate piece 11 between the stop block 17 and the pressing member 12 is sufficiently strong. Unfortunately, a precious inner surface area of the housing 14 is consumed by installing the reset button 10 thereon. Moreover, the stop block 17 is required, resulting in an increase in the manufacturing cost and a complicated construction. Thus, it is desirable among manufacturers of the art to provide an improved resilient switch with a simple construction so as to be produced in a cost effective manner.

SUMMARY OF THE INVENTION

After considerable research and experimentation, a resilient switch according to the present invention has been devised so as to overcome the above drawback of the prior art.

It is an object of the present invention to provide a resilient switch mounted in a housing and comprising a flexible arm including a first seat formed on one end of the flexible arm and a second seat formed on the other end of the flexible arm. After fastening the second seat on a first inner surface of the housing, the pressing member projects out of the housing through an opening on the first inner surface of the housing. A first projection is formed on a second surface of the flexible arm opposite the pressing member and is disposed proximate the second seat. A portion of the first projection opposite the flexible arm is extended to be proximate a second inner surface of the housing, which is opposite to the first inner surface of the housing. By utilizing this resilient switch, the first seat moves toward the second inner surface of the housing when a pressing force is exerted upon the pressing member. A portion of the flexible arm from the first projection to the first seat is resiliently deflected with a resilient bouncing force stored therein. Thus, the resilient bouncing force can push the pressing member out of the housing again in response to removing the pressing force exerted upon the pressing member.

In one aspect of the present invention there is provided a second projection formed on a first surface of the flexible arm opposite the first projection. The second projection is aligned with the first projection. The second projection is disposed proximate the first inner surface of the housing having the opening formed therein. Thus, the flexible arm is confined in the housing by disposing the first and second projections between the two inner surfaces of the housing.

In another aspect of the present invention there is provided a first fixing member on the second seat. The first fixing member is adapted to fasten an inner second fixing member projected from the first inner surface of the housing so as to secure the second seat to the housing.

In a further aspect of the present invention the flexible arm is shaped as a C so as to line up the first seat with the second seat. This can decrease a distance between the first seat and the second seat by maintaining the total length of the flexible arm unchanged.

The above and other objects, features and advantages of the present invention will become apparent from the following detailed description taken with the accompanying drawings.

DETAILED DESCRIPTION OF THE PREFERRED EMBODIMENTS

Figure 1:
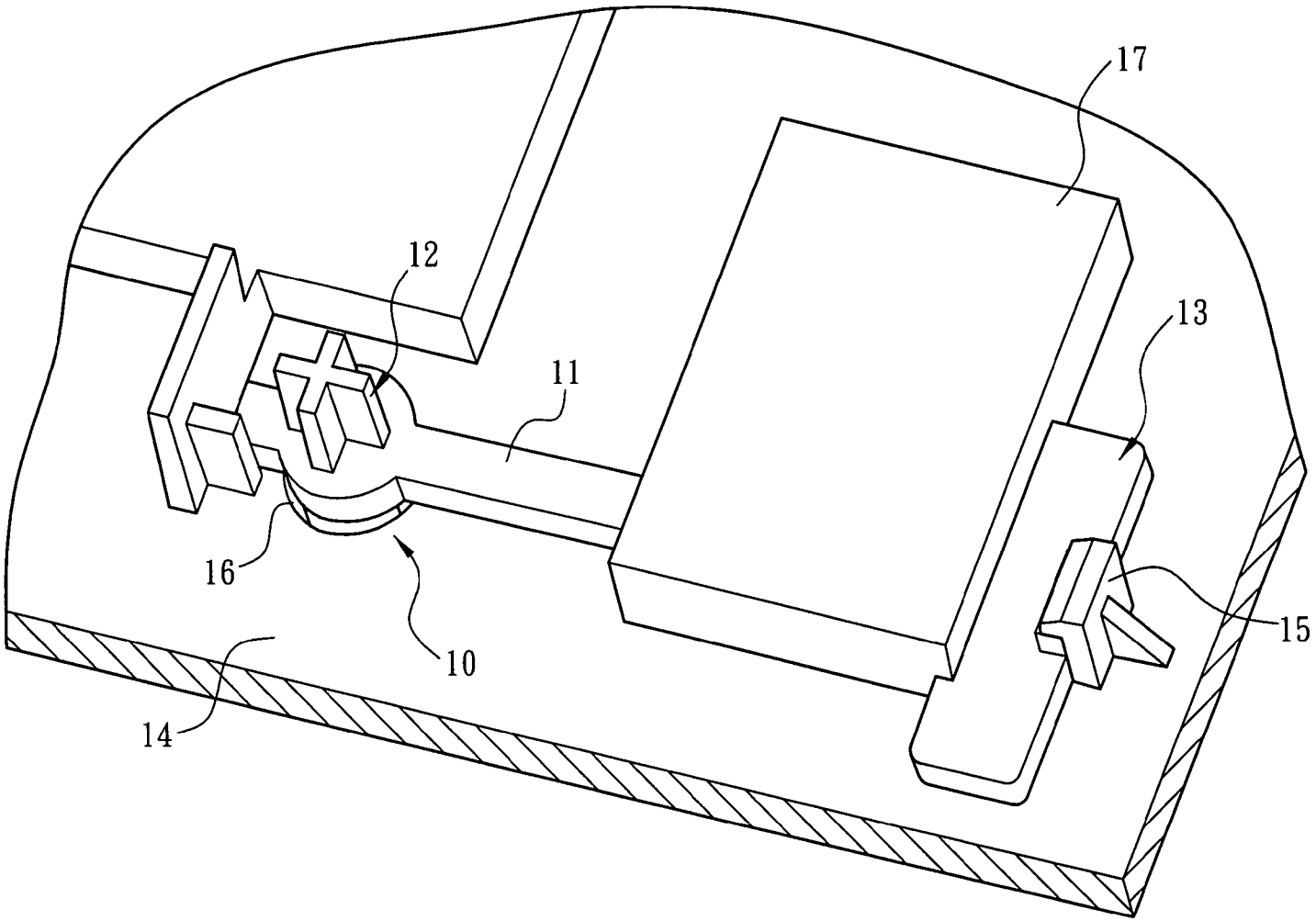
FIG. 1 (Prior Art)
FIG. 1 is a perspective view of a conventional reset button mounted on a computer.
Figure 2:
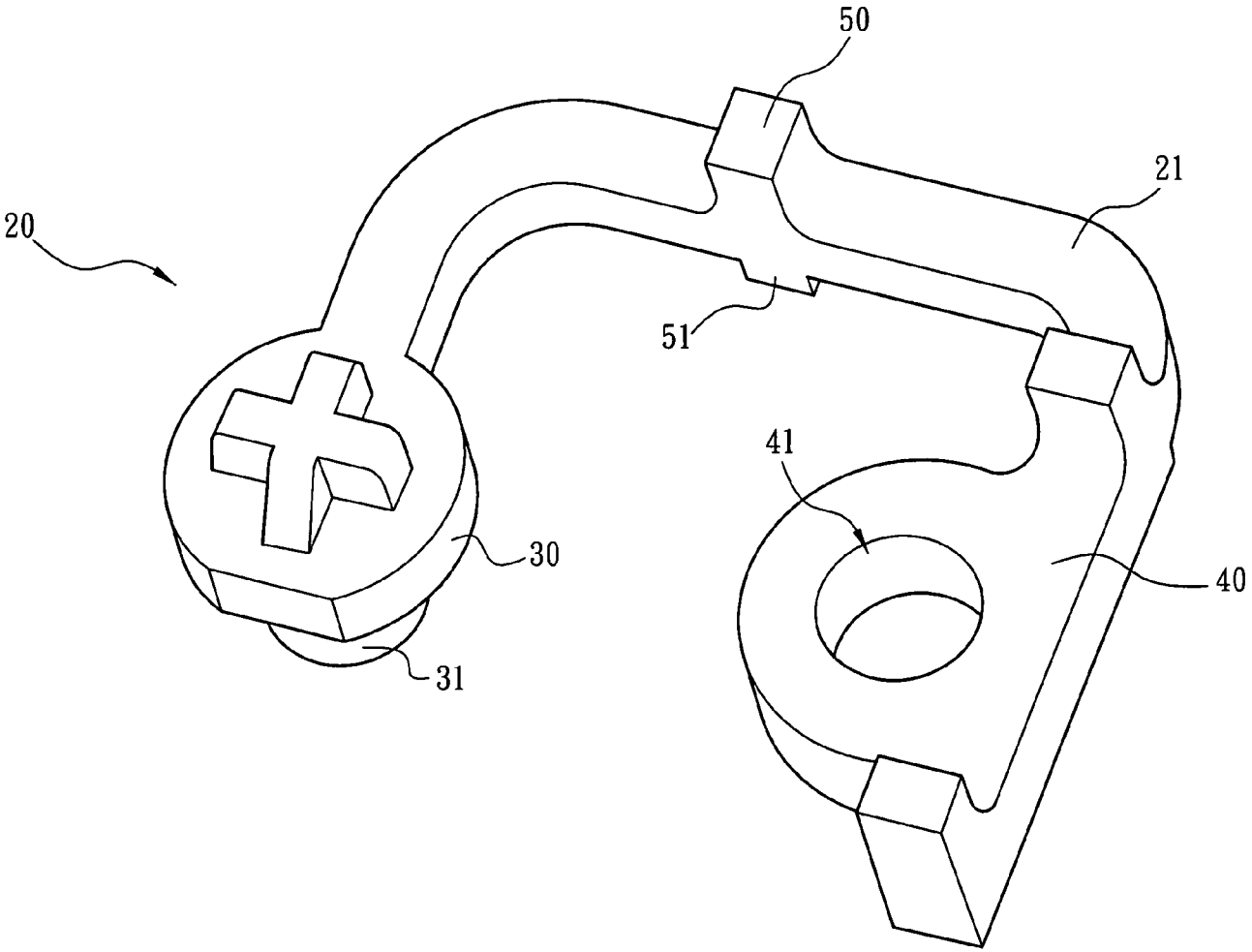
FIG. 2 is a perspective view of a preferred embodiment of resilient switch according to the invention.
Figure 3:
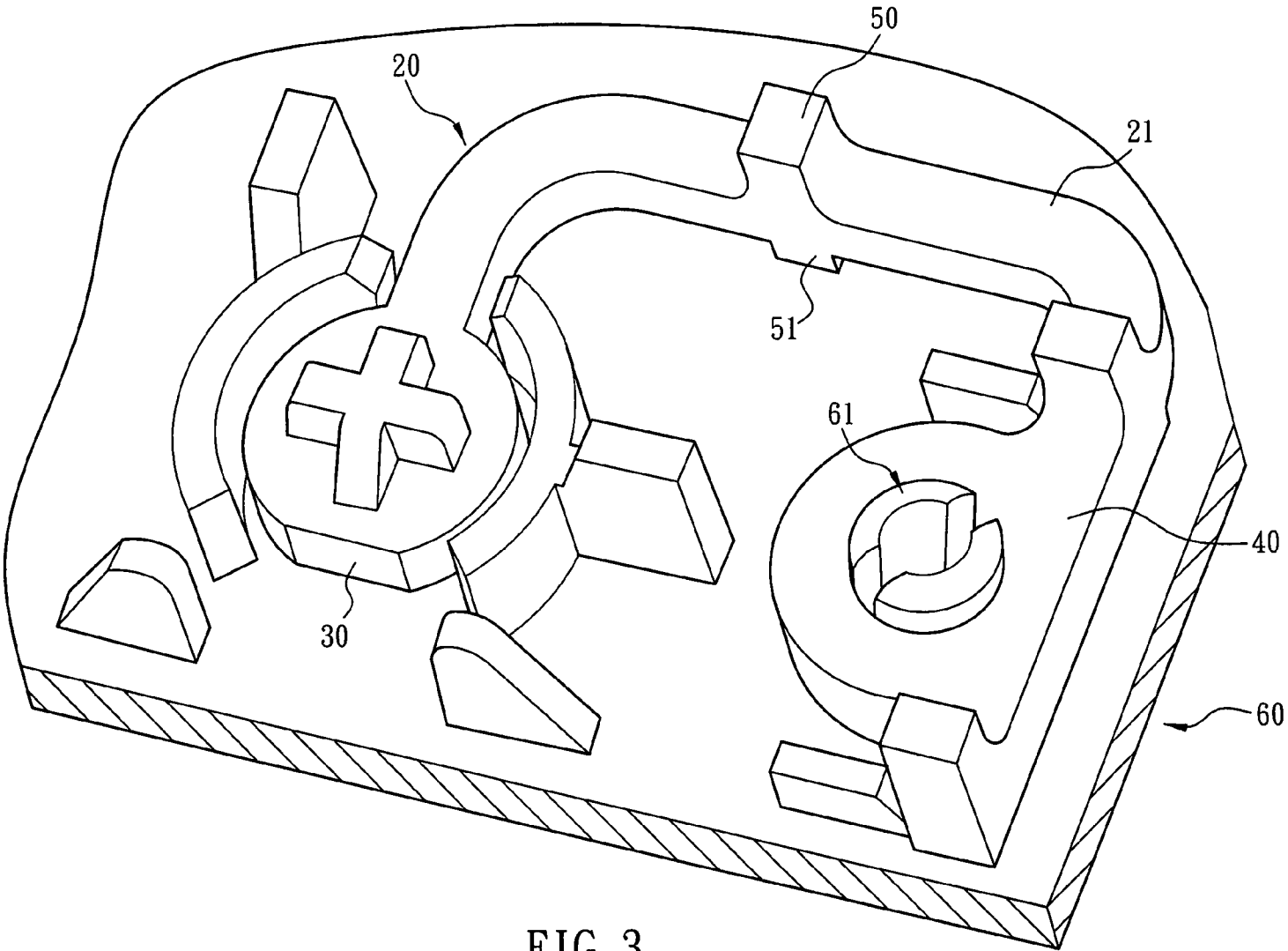
FIG. 3 is a perspective view of the resilient switch mounted on a surface of a housing.
Figure 4:
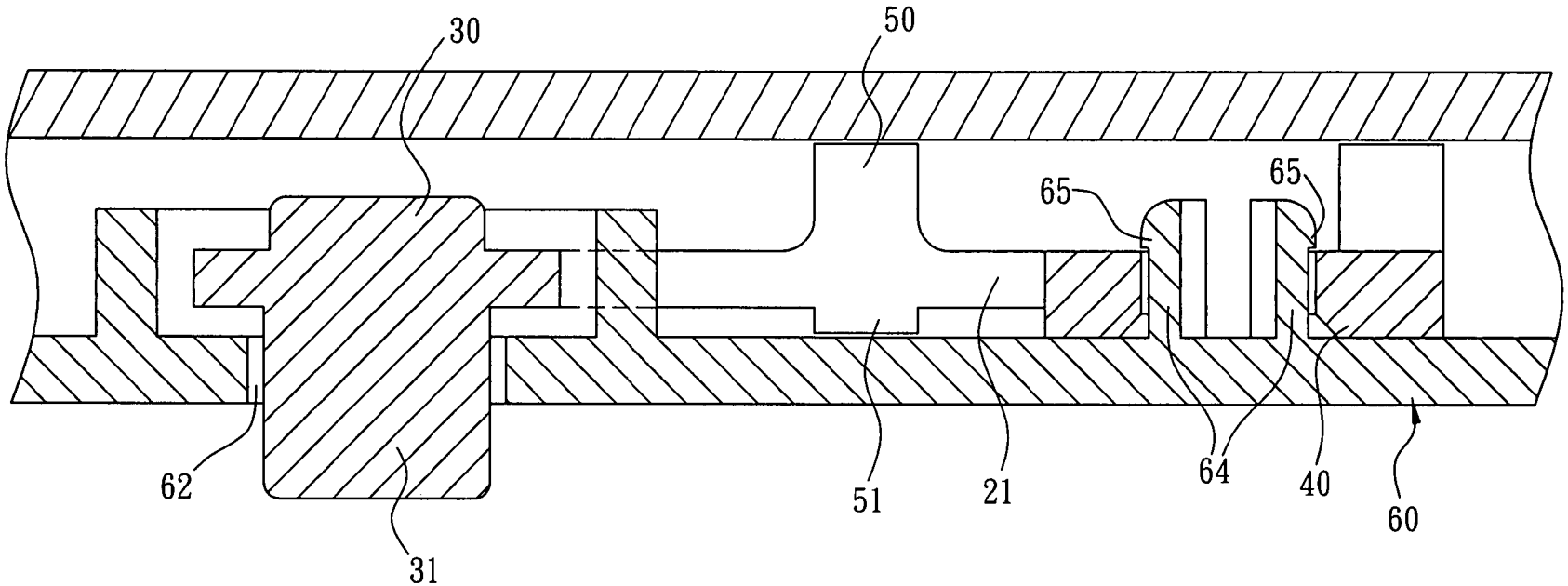
FIG. 4 is a sectional view of FIG. 3 for showing its operation.

Referring to FIGS. 2 and 3, a resilient switch 20 in accordance with a preferred embodiment of the invention is shown. The resilient switch 20 comprises a flexible arm 21. A first seat 30 is formed on one end of the flexible arm 21. A pressing member 31 is formed on a first surface of the first seat 30. A user may press the pressing member 31. A second seat 40 is formed on the other end of the flexible arm 21. A first fixing member 41 is formed in the second seat 40. The first fixing member 41 is adapted to fasten a second fixing member 61 formed on a first inner surface of a housing 60 so as to secure the second seat 40 to the first inner surface of the housing 60. A first projection 50 is formed on a second surface of the flexible arm 21 opposite the pressing member 31. The first projection 50 is disposed between both ends of the flexible arm 21. The first projection 50 also can be disposed proximate the other end of the flexible arm 21 in the other embodiment. The first projection 50 projects a predetermined distance out of the flexible arm 21. Referring to FIG. 4 in conjunction with FIG. 3, the first seat 30 is aligned with an opening 62 on the first inner surface of the housing 60 when the second seat 40 is fastened in the housing 60. Also, the pressing member 31 projects out of the housing 60 through the opening 62 with a portion of the first projection 50 opposite the flexible arm 21 being adjacent a second inner surface of the housing 60. The second inner surface of the housing 60 is at the position opposite to the first inner surface of the housing 60 having the opening 62.

Referring to FIG. 4 again, the first seat 30 moves toward the second inner surface of the housing 60 when a user presses the pressing member 31 projected out of the first inner surface of the housing 60. Further, the first projection 50 moves toward the second inner surface of the housing 60 until being stopped by the second inner surface of the housing 60. At this time, a portion of the flexible arm 21 from the first projection 50 to the first seat 30 is resiliently deflected with a resilient bouncing force stored therein. Thus, the resilient bouncing force can push the pressing member 31 out of the housing 60 again in response to removing the pressing force exerted upon the pressing member 31.

Referring to FIGS. 2, 3, and 4 again, a second projection 51 is formed on a first surface of the flexible arm 21 opposite the first projection 50. Further, the second projection 51 is aligned with the first projection 50. The first seat 30 is aligned with the opening 62 of the housing 60 when the second seat 40 is fastened in the housing 60. Also, the pressing member 31 projects out of the housing 60 through the opening 62. Further, the portion of the first projection 50 opposite the flexible arm 21 is extended to be proximate the second inner surface of the housing 60. Furthermore, the second projection 51 in the housing 60 is disposed proximate the first inner surface of the housing 60. Thus, the flexible arm 21 is fastened in the housing 60 by disposing both open ends of the first and second projections 50 and 51 very proximate two inner surfaces of the housing 60 respectively. Thus, the first seat 30 moves toward the second inner surface of the housing 60 when a user presses the pressing member 31 projected out of the housing 60. Further, the open end of the first projection 50 and the open end of the second projection 51 are confined by the two inner surfaces of the housing 60 respectively. Thus, the first seat 30 is only allowed to move a predetermined distance (i.e., the movement is stopped when the first projection 50 engages with the second inner surface of the housing 60). At this time, a portion of the flexible arm 21 from the first projection 50 or from the second projection 51 to the first seat 30 is resiliently deflected with a resilient bouncing force stored therein. Thus, the resilient bouncing force can push the pressing member 31 out of the housing 60 again in response to removing the pressing force exerted upon the pressing member 31.

Referring to FIGS. 2, 3, and 4 again, the first fixing member 41 of the second seat 40 is implemented as a through hole. The second fixing member 61 is implemented as a split latch. For securing the first fixing member 41 to the second fixing member 61, a user may insert the latch 61 into the through hole 41. The latch 61 is fastened by the second seat 40 after an open end of the latch 61 opposite the first inner surface of the housing 60 projecting out of the through hole 41. The latch 61 is comprised of two opposite uprights 64 with a gap formed therebetween. A periphery of both the uprights 64 is substantially conformed to a diameter of the through hole 41. A sharp latching piece 65 is formed at an open end of the upright 64 distal the housing 60 with one end of the first fixing member 61 formed thereat. A periphery of both the latching pieces 65 is slightly larger than the diameter of the through hole 41. In the process of inserting the latch 61 through the through hole 41, portions of the uprights 64 with the latching pieces 65 formed thereon are first compressed toward each other when the latch 61 is in the through hole 41. At this time, the periphery of both the latching pieces 65 is conformed to the diameter of the through hole 41. This permits the latch 61 to pass the through hole 41 smoothly. Both the uprights 64 suddenly expand to return to their original positions after the portions of the uprights 64 with the latching pieces 65 formed thereon passing the through hole 41. In the expanded state of the uprights 64, the periphery of both the latching pieces 65 is again larger than the diameter of the through hole 41. As a result, the second seat 40 is fastened between the latching pieces 65 and the first inner surface of the housing 60 with the second fixing member 61 projected therefrom.

Referring to FIG. 2 again, the flexible arm 21 is shaped as a C or U so as to line up the first seat 30 with the second seat 40. This can decrease a distance between the first and second seats 30 and 40 by maintaining the total length of the flexible arm 21 unchanged. This has the advantage of decreasing the space required for installing the flexible arm 21 in the housing 60. As a result, the housing 60 can be made much smaller.

While the invention herein disclosed has been described by means of specific embodiments, numerous modifications and variations could be made thereto by those skilled in the art without departing from the scope and spirit of the invention set forth in the claims.

What is claimed is:

1. A resilient switch mounted in a housing comprising:

a flexible arm mounted in a first inner surface of said housing;

a first seat formed on one end of said flexible arm and including a pressing member formed on a first surface of said first seat, said pressing member projected out of said housing through an opening on said first inner surface of said housing;

a second seat formed on the other end of said flexible arm and including a first fixing member for fastening said second seat to a second fixing member on said first inner surface of said housing; and a first projection formed on a second surface of said flexible arm opposite said pressing member and disposed between both ends of said flexible arm, said first projection projected a predetermined distance out of said flexible arm to be proximate a second inner surface of said housing opposite said first inner surface of said housing.

2. The resilient switch of claim 1, further comprising a second projection formed on the first surface of said flexible arm opposite said first projection, said second projection aligned with said first projection.

3. The resilient switch of claim 1, wherein said first fixing member is a through hole and said second fixing member is a latch.

4. The resilient switch of claim 3, wherein said latch includes two opposite uprights with a gap formed therebetween such that a periphery of said uprights is substantially conformed to a diameter of said through hole, each of said uprights including a sharp latching piece formed at an open end distal said first inner surface of said housing with one end of said first fixing member formed thereat, said latching pieces having a periphery larger than the diameter of said through hole.

5. The resilient switch of claim 1, wherein said flexible arm is shaped as a C.

6. The resilient switch of claim 1, wherein said first projection disposed between both ends of said flexible arm is proximate said second seat.

* * * * *